US007701398B2

(12) United States Patent
Körner

(10) Patent No.: US 7,701,398 B2
(45) Date of Patent: Apr. 20, 2010

(54) ANTENNA FOR PORTABLE COMMUNICATION DEVICE

(75) Inventor: Hans Peter Körner, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 539 days.

(21) Appl. No.: 11/539,430

(22) Filed: Oct. 6, 2006

(65) Prior Publication Data

US 2008/0084356 A1 Apr. 10, 2008

(51) Int. Cl.
*H01Q 1/24* (2006.01)

(52) U.S. Cl. ..... 343/702

(58) Field of Classification Search ..... 343/702, 343/718; 455/575.2
See application file for complete search history.

(56) References Cited

U.S. PATENT DOCUMENTS

| | | | | |
|---|---|---|---|---|
| 5,903,822 | A * | 5/1999 | Sekine et al. | 455/575.7 |
| 6,718,157 | B1 * | 4/2004 | Choi | 455/3.01 |
| 6,725,057 | B1 * | 4/2004 | Boyle | 455/550.1 |
| 6,791,498 | B2 * | 9/2004 | Boyle et al. | 343/702 |
| 6,922,174 | B2 * | 7/2005 | Haunberger et al. | 343/702 |
| 7,236,137 | B2 * | 6/2007 | Yoshino et al. | 343/718 |
| 7,283,853 | B2 * | 10/2007 | Kanazawa et al. | 455/575.1 |
| 2006/0166719 | A1 * | 7/2006 | Arad et al. | 455/575.2 |
| 2007/0290922 | A1 * | 12/2007 | Lee | 342/374 |
| 2008/0231523 | A1 * | 9/2008 | Yanagi et al. | 343/702 |

FOREIGN PATENT DOCUMENTS

| | | | |
|---|---|---|---|
| EP | 1 589 609 | A2 | 10/2005 |
| EP | 1 589 609 | A3 | 10/2005 |
| EP | 1 605 545 | A1 | 12/2005 |
| EP | 1 608 036 | A2 | 12/2005 |
| EP | 1 659 822 | A1 | 5/2006 |
| GB | 2 183 099 | A | 5/1987 |
| WO | WO 03/026342 | A2 | 3/2003 |
| WO | WO 03/026342 | A3 | 3/2003 |

OTHER PUBLICATIONS

International Search Report and Written Opinion dated May 7, 2007.

* cited by examiner

*Primary Examiner*—Huedung Mancuso
(74) *Attorney, Agent, or Firm*—Harrity & Harrity, LLP

(57) ABSTRACT

The present invention relates to an antenna unit (500, 600) and a portable device (10) comprising such an antenna unit. The antenna unit (500, 600) may include at least two antenna elements (510B, 510C) forming a television antenna (600) arranged in a cable adapted for detachably connecting an auxiliary device (500) to the portable device (10). The at least two antenna elements form a dipole antenna that provides good properties over a known frequency range without requiring any additional circuitry or signal processing for the device (10) and without requiring or occupying any space within the device (10).

23 Claims, 3 Drawing Sheets

ANTENNA FOR PORTABLE COMMUNICATION DEVICE

FIELD OF THE INVENTION

The present invention relates generally to the field of antennas and more particularly, to television antennas for use in connection with portable communication devices.

BACKGROUND OF THE INVENTION

Recent trends in modern communications device are rendering these devices smaller and more functional on an ever-increasing basis. Because many of these devices incorporate displays, one functionality being investigated and implemented in communications devices is the reception and display of television signals. In addition, modern phones have fairly large colour screens. In particular, devices such as mobile telephones are being provided with broadcast television tuners and large color displays for displaying received television signals to users.

Unfortunately, one recognized problem with the reception of television signals on portable devices is that it typically requires a relatively large sized antenna in order to cover the entire frequency band being used by available broadcasters. Successfully implementing an effective antenna for television signals has been a major obstacle in providing television signals to mobile telephones or other portable communication devices, where the size of the device is generally of primary or critical.

Prior attempts to solve this problem have used a single antenna for both communication (e.g., cellular communication) as well as reception of broadcast television signals. However, this solution has been ineffective in that the frequencies used for telephone communication and television broadcasts are quite different. Therefore, the single-antenna approach is unduly compromising and provides inferior performance for both communications and television reception. In order to increase performance in a single-antenna solution, additional circuitry and/or additional signal processing may be incorporated into the communication device. Unfortunately, this modified approach suffers from an increase in physical size. Additionally, increasing processing requirements for the portable device has the further disadvantage of decreasing usable battery life of the device. Another hurdle to the single-antenna approach results from the requirement of a ground plane in the device, which is a technical challenge to accomplish in connection with such small portable devices, such as mobile telephones, especially with respect to a television antenna.

SUMMARY OF THE INVENTION

According to one aspect of the present invention, an antenna unit for a portable electronic device includes a cable connected to the portable electronic device, and at least one pair of antenna elements formed in the cable.

Additionally, the at least one pair of antenna elements form a dipole antenna in the cable.

Additionally, a feed point of the dipole antenna is positioned in an essentially symmetric manner with respect to the antenna elements.

Additionally, the antenna is arranged to be operatively fed in a substantially balanced manner.

Additionally, the antenna is arranged to be operatively fed in a balanced manner by one of: a balun or a matching network.

Additionally, the cable includes a plurality of conductors extending along a length of the cable, where the at least one pair of antenna elements is formed by at least one of the conductors.

Additionally, the cable includes a shield extending along an outer length of the cable, where the at least one pair of antenna elements is formed by the shield.

Additionally, at least one additional antenna element is arranged on the outside of the at least one antenna element formed by the shield.

Additionally, the at least one pair of antenna elements are separated by a gap.

Additionally, the gap includes a high frequency trap configured to disrupt high frequency signals while passing low frequency signals.

Additionally, the gap includes a high frequency blocking device provided between the antenna elements in the at least one pair of antenna elements.

Additionally, the antenna elements have lengths proportionate to a wavelength of a signal to be received.

Additionally, the antenna elements have lengths represented as: length=$N \cdot \lambda/4$, where N is an integer.

Additionally, each antenna element has a different length.

Additionally, a plurality of antennas are formed by pairs of antenna elements being arranged substantially one after the other along the cable.

Additionally, a plurality of antennas are formed by antenna elements using shared dipole-halves.

Additionally, the portable electronic device comprises a mobile telephone.

Additionally, the cable connected to the portable electronic device auxiliary device comprises a headset.

According to another aspect, a portable communication device provided with an antenna unit includes at least two antenna elements forming a dipole antenna arranged in a cable connecting an auxiliary device to the portable device.

Additionally, the cable includes a plurality of inner conductors, where the at least two antenna elements are formed by at least one of the inner conductors.

Additionally, the cable comprises a shield and wherein the dipole antenna is formed by at least two antenna elements formed by the shield.

Additionally, a plurality of dipole antennas are formed by antenna elements arranged one after the other along the cable.

Additionally, a plurality of antennas are formed by antenna elements using shared dipole-halves.

Additionally, the at least two antenna elements are separated from each other and from the rest of the cable by high frequency traps.

Additionally, the portable communication device is a digital media player.

Additionally, the auxiliary device is a headset.

In yet another aspect, an external antenna configured to receive television signals, includes a pair of antenna elements separated by a high frequency blocking device, where a length of the antenna elements in the pair of antenna elements is related to a wavelength of the received television signals. A feed point is operatively connected to the antenna elements substantially between the pair of antenna elements, where the feed point is operatively connected to a receiver for receiving the television signals.

Additional aspects and embodiments thereof will become apparent from the following detailed description.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

The present invention relates to an antenna for use with portable electronic device to enable or facilitate the reception of television signals by the portable electronic device. The following description relates primarily to portable communication devices configured to perform conventional telecommunications functions (e.g., telephone calls, text and multimedia messaging, etc.) as well as television reception functions. However, it should be noted that aspects of the invention are not limited to communication devices, and may include any suitable portable electronic device, such as a media player, a personal digital assistant, a watch, etc.

Figure 1:
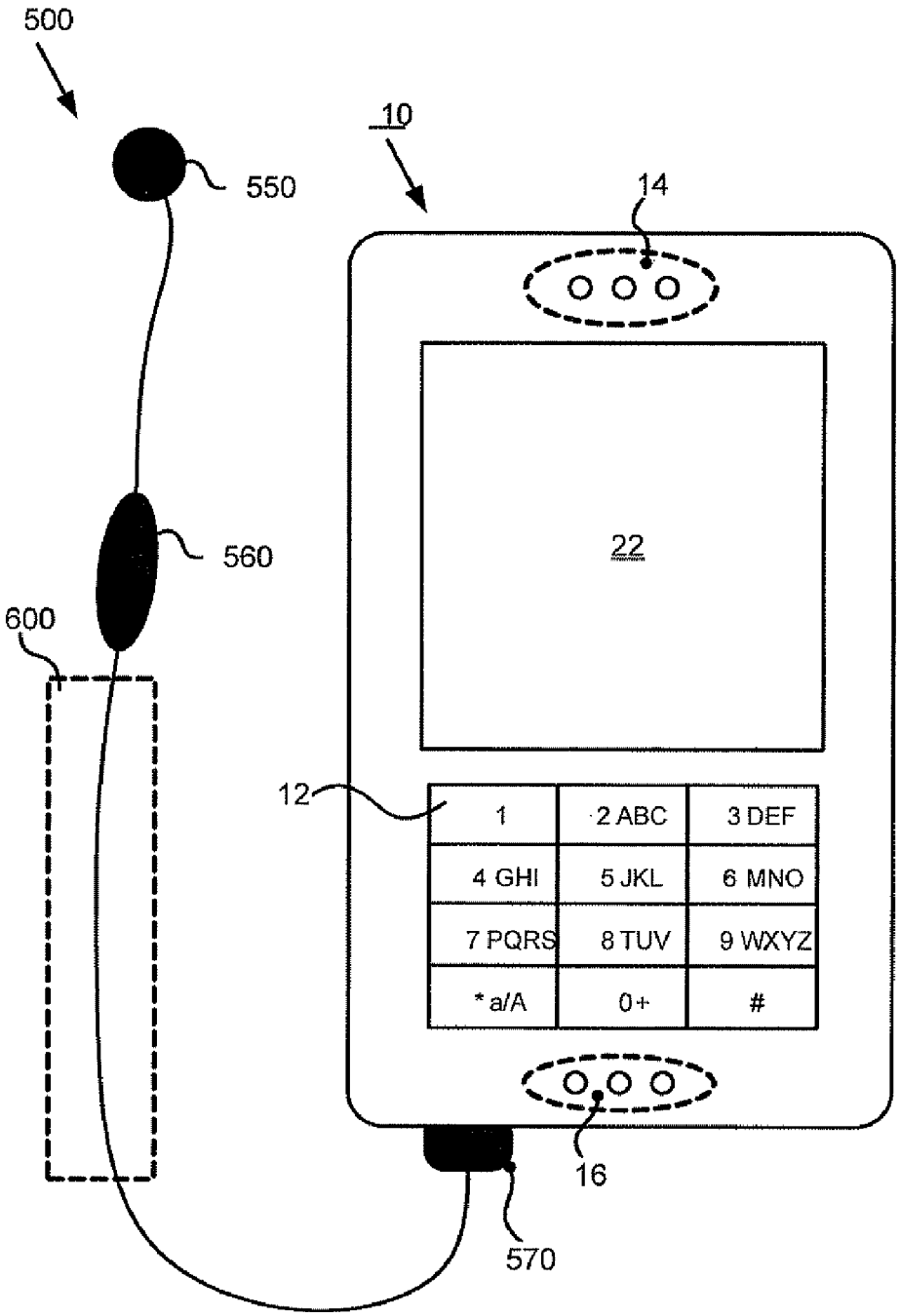
FIG. 1 is a schematic view of a portable communication device in the form of a mobile telephone.

FIG. 1 is a schematic view of a portable communication device in the form of a mobile telephone 10. Mobile telephone 10 may be configured to operate according to 3G-technology (e.g. W-CDMA or CDMA2000), 2.5-technology (e.g. GPRS) or 2G-technology (e.g. GSM) or similar technology. Information about 3G-technology, 2.5G-technology and 2G-technology can e.g. be found in specifications from the 3$^{rd}$ Generation Partnership Project (3GPP), see e.g. the web-site at www.3gpp.org.

As shown, mobile telephone 10 may include a keypad 12, a loudspeaker 14, and a microphone 16. Keypad 12 may be used to select functions or to respond to prompts from mobile telephone 10. Alternative, keypad 12 may be used to enter alpha-numeric information. Keypad 12 may be of any suitable kind, including but not limited to keypads with suitable push-buttons or touch-buttons or similar and/or a combination of different suitable button arrangements. Loudspeaker 14 may be configured to present sounds or other audible information to a user and microphone 16 may be configured to sense or receive a users vocal input. Mobile telephone 10 may include a telecommunication antenna (not shown), configured to facilitate reception and transmission of telecommunication signals via a telecommunication network. In the illustrated implementation, the telecommunication antenna may be integrated within mobile telephone 10. In alternate configurations, the telecommunication antenna may be physically or operatively connected to suitable electronics or circuitry within mobile telephone 10.

Mobile telephone 10 may also include a display 22 for displaying graphical information or content to a user. For example, display 22 may be configured to display images and video sequences, and in particular, images and video sequences from a received television signal or similar multimedia signals received by the mobile telephone 10. Details relating to the reception of television signals will be set forth in additional detail below.

In one embodiment, mobile telephone 10 may be provided with a detachable headset 500 including a loudspeaker 550 and a microphone 560. As shown, headset 500 may be detachably connected to mobile telephone 10 by means of an electrical plug or connector 570. It should be understood that the illustrating of FIG. 1, depicts only one exemplary configuration of headset 500. Accordingly, additional headset configurations having different relative sizes and shapes, as well as loudspeaker 550, microphone 560 and plug 570 configurations may be implemented without departing from the spirit or scope of the invention.

As described above, a mobile telephone, such as mobile telephone 10, is one exemplary portable device in which aspects of the invention may be implemented. Such aspects may be similarly implemented in other types of portable electronic devices, such as PDA's, palm top computers, laptop or notebook computers, smartphones, digital media players, or any other suitable portable device.

Figure 2:
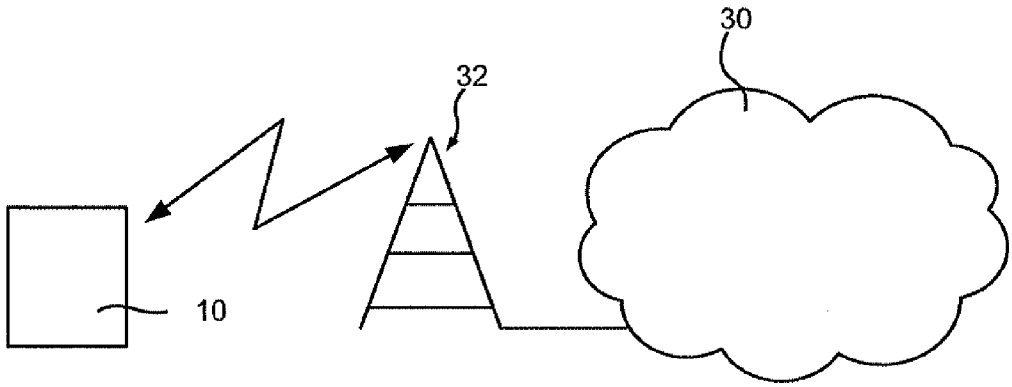
FIG. 2 is an exemplary telecommunication system incorporating the mobile telephone of FIG. 1.

FIG. 2 is an exemplary telecommunication system incorporating mobile telephone 10 of FIG. 1. As illustrated, mobile telephone 10 may be operatively connected to a cellular network 30 via a base station 32. Cellular network 30 may be any suitable type of mobile telecommunications network, including but not limited to a 3G network such as a WCDMA (wideband code division multiple access) network, a GPRS (general packet radio service) network, or any other 2G, 2.5G or 2.75G network. Moreover, in some implementations, network 30 may not include a cellular network, but may include additional network types such as the Internet, a corporate intranet, a LAN, a wireless LAN, etc.

Figure 3:
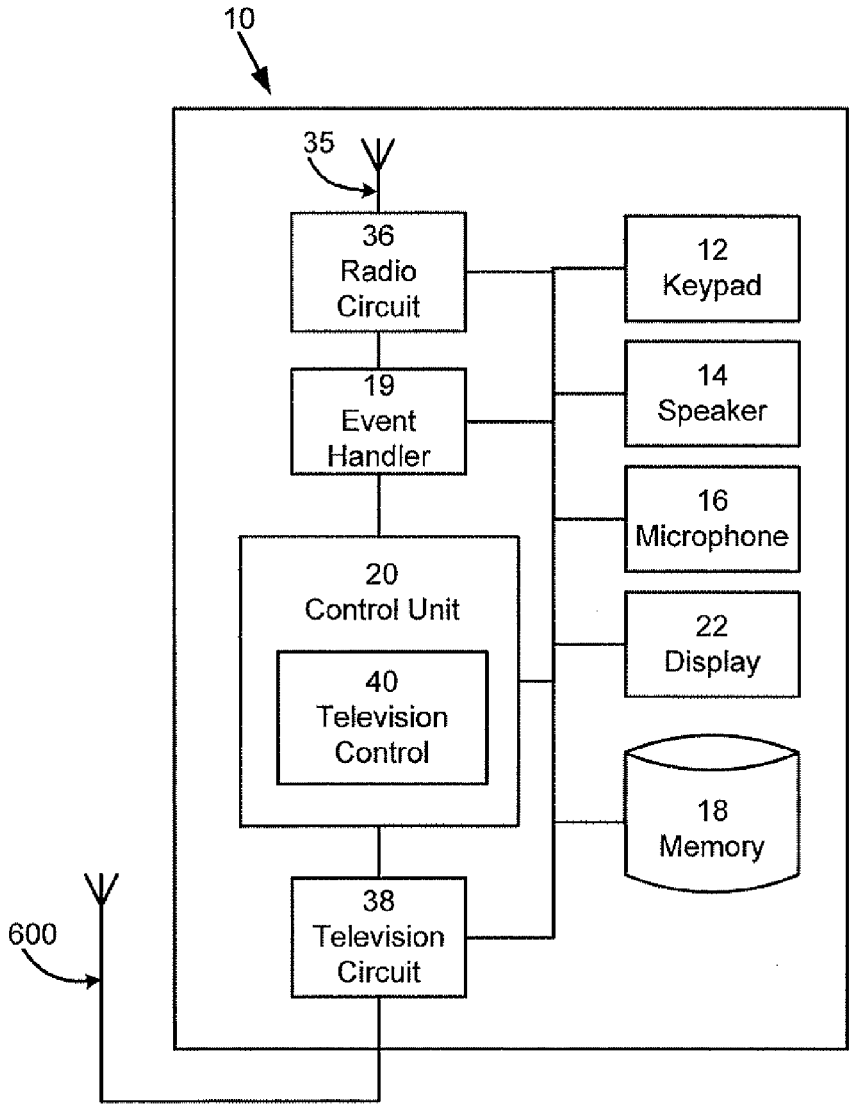
FIG. 3 is a schematic block diagram illustrating exemplary functional elements of the mobile telephone of FIGS. 1 and 2.

FIG. 3 is a schematic block diagram illustrating exemplary functional elements of the mobile telephone of FIGS. 1 and 2. As discussed above, mobile telephone 10 may include keypad 12, speaker 14, microphone 16, and display 22. In addition to these elements, mobile telephone 10 may be further configured to include a memory 18 for storing data or other information, and in particularly for storing data and/or data files produced and/or used by mobile telephone 10. Memory 18 may be any suitable memory type used in portable devices.

As discussed above, mobile telephone 10 may be configured to include antenna 35 connected to a radio circuit 36 for enabling radio communication with the network 30. Radio circuit 36 may, in turn, be connected to an event handling unit 19 for handling such events as outgoing and incoming communication to and from network 30, such as telephone calls, text (e.g., SMS (short message service)) messages, multimedia (e.g., MMS (multimedia messaging service)) messages, or data communications facilitated over network 30 (e.g., email, internet browsing requests and files, etc.).

In one implementation, mobile telephone 10 may be configured to include a television unit 38 operative connected to an exterior antenna 600 for enabling receipt of a broadcast television signal by mobile telephone 10. Television unit 38 may include a television tuner configured to receive, demodulate, and decode the received television signal. Once received and decoded, the television signal may be converted into visible image and audio for presentation by display 22 and loudspeaker 14 (or headset loudspeaker 550), respectively. In addition to the television tuner, television unit 38 may also include other units or elements for processing or displaying the received television signal (e.g., signal processors, amplifiers, etc.). Furthermore, it should be understood that television unit 38 may be configured to receive any suitable broadcast format, such as analog television signals (e.g., NTSC (national television standards committee), PAL (phase alternating line), and SECAM (sequential color memory) signals) or digital television signals (e.g., ATSC (advanced television standards committee), DVB (digital video broadcasting), DMB (digital multimedia broadcasting), and ISDB (integrated services digital broadcasting) signals).

Mobile telephone 10 may include a control unit 20 configured to control and supervise the operation of mobile telephone 10. Control unit 20 may be implemented by means of hardware and/or software, and it may include one or several hardware units and/or software modules, e.g. one or several processor units provided with or having access to the appropriate software and hardware required by the functions of the mobile telephone 10. As shown in FIG. 3, control unit 20 may be operatively connected to keypad 12, speaker 14, microphone 16, memory 18, event handling unit 19, display 22, radio unit 36, and television unit 38 to facilitate control and communicate with these units by exchanging information and instructions therewith.

In one embodiment, control unit 20 may include a television control unit 40. As with control unit 20, television control unit 40 may be implemented in any suitable combination of hardware and/or software and may include one or several hardware units and/or software modules. Television control unit 40 may be configured to operatively process television signals received by television unit 38. In particular, television control unit 40 may be arranged to operatively adapt or convert the received television signal into a format suitable for output on display 22 and to forward the adapted signal to display 22 for presentation to a user.

Although certain elements and combinations of elements have been described above, with respect to FIG. 3, it should be noted that the described arrangements are merely exemplary and that a portable device configured consistent with aspects of the invention may include additional parts and units or similar elements to those described above.

Figure 4:
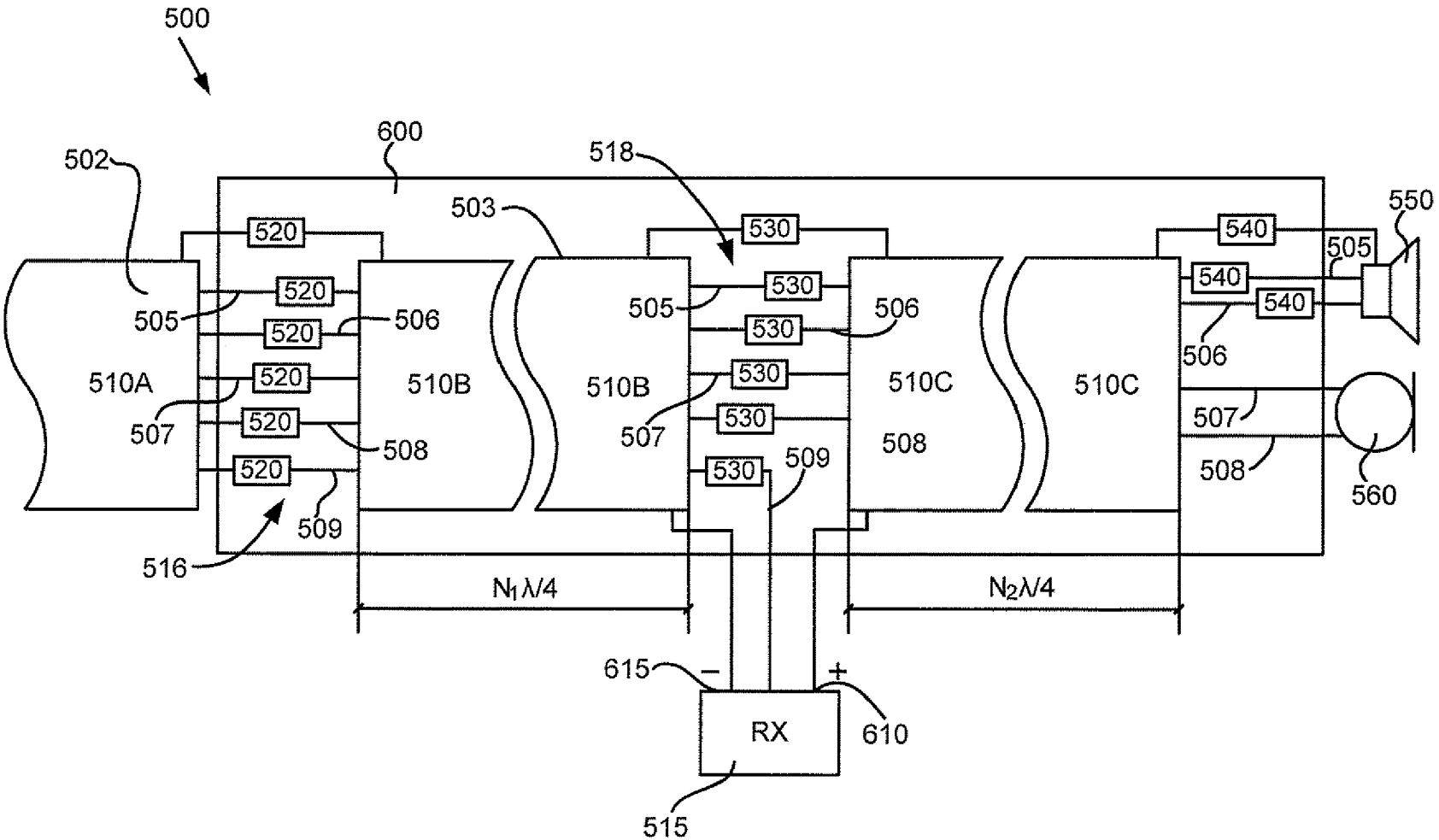
FIG. 4 is a block diagram illustrating a dipole antenna implemented in the headset of FIG. 1.

FIG. 4 is a block diagram illustrating a dipole antenna implemented in the headset of FIG. 1 for facilitating reception of broadcast television signals. Headset 500 may include an elongated cable 502 having an outer shield 503 enclosing a plurality of inner conductors or wires 505. In one exemplary implementation, headset cable 502 may include four inner conductors 505, 506, 507, and 508 of which a first pair (e.g., 505 and 506) may be connected to loudspeaker 550 and a second pair (507 and 508) may be connected to microphone 560. It should be understood that additional conductors may be provided in headset 500 if necessary to support additional functions of headset 500. For example, if the function of headset 500 or the control of a receiver RX 515 (discussed below) requires additional conductors. The existence of additional conductors has been schematically illustrated in FIG. 4 by in an exemplifying fifth conductor 509 that may be connected to receiver RX 515. Conductor 509 may be used to send commands to receiver RX 515 and/or to send signals received and demodulated by receiver RX 515 to other units, such as to television circuit 38 in mobile telephone 10.

As shown in FIG. 4, headset cable 502 may be divided into tee cable sections 510A, 510B 510C. The entire length of each of the sections 510A, 510B, and 510C is not illustrated. This is indicated by curved lines in FIG. 4. Section 510A may be configured to end in electrical plug 570 described above to facilitate attachment to mobile telephone 10 (see FIG. 1). In one implementation, section 510A and section 510B of cable 502 may be separated by a gap 516. Similarly, cable section 510 and cable section 510C may be separated by a gap 518. In one embodiment, gaps 516 and 518 between cable sections 510A and 510B, and 510B and 510C, respectively, may be sufficiently large to operate as disruptions in the cable with respect to high frequencies (e.g., the high radio frequencies associated with broadcast television signals).

To maintain suitable high frequency disruptions while maintaining non-disrupter operation for lower frequencies (e.g., those frequency ranges associated with human speech or hearing, or frequency ranges associated with command or control signals propagated or transmitted through cable 202), shield 503 and conductors 505-509 of cable 502 may be provided with high frequency blocking devices 520 and 530 arranged in gaps 516 and 518, respectively. The high frequency blocking devices 520 and 530 may be configured to block the high frequencies while simultaneously bridging gaps 516 and 518 for the lower frequency signals.

In one implementation, a first high frequency trap may be formed by blocking devices 520 arranged between the first and second cable sections 510A and 510B in gap 516, while a second high frequency trap may be formed by blocking devices 530 arranged between the second and third cable sections 510 and 510C in gap 518. Exemplary high frequency blocking devices 520 and 530 may be formed of any suitable material or device, such as high impedance inductors and/or ferrite beads, or tuned networks, etc.

In situations where headset 500 additional conductors that extend a significant distance outside cable 502 of the headset 500 compared to a wavelength of the high frequency signals (thereby rendering them susceptible to the high frequencies), additional high frequency blocking devices may be provided for these conductors. For example, high frequency blocking devices 540 forming a third high frequency trap may be provided at conductors 505 and 506 extending from the end of the third cable section 510C to loudspeaker 550. Similarly, conductors 507 and 508 extending from the end of the third cable section 510C to microphone 560 may not be provided with high frequency blocking devices, since it may be assumed that conductors 507 and 508 extend a short distance compared to the wavelength of the high frequency signals, so as to be insensitive to these high frequencies. However, if the length of conductors 507 and 508 extending from section 510C to microphone 560 has a longer length when compared to the wavelength of the high frequency signals, additional high frequency blocking devices may be provided.

In one aspect, gaps 516 and 519 between the cable sections 510A, 510B, 510C, respectively, may be arranged so that a length of the second cable section 510B and a length of the third cable sections 510C correspond to at least ¼ of the wavelength used to broadcast the television signal to be received by either receiver RX 515 or by television circuit 38 in mobile telephone 10 (i.e., $\lambda/4$, where $\lambda$ denotes the wavelength of the signal). However, in addition to $\lambda/4$, it should be noted that the length of the cable section may also be N times $\lambda/4$, where N is any integer. In this manner, the lengths of the cable sections 5103 and 510C may have different values, while each maintaining a N $\lambda/4$ relationship with respect to the broadcast wavelength. For example, section 510B may have a length of $N_1\lambda/4$ and section 510C may have a length of $N_2\lambda/4$, where $N_1=1$ and $N_2=3$.

By providing cable section lengths and gaps therebetween in the manner described above, cable sections 510B, 510C and the and the high frequency blocking devices 520, 530, 540 may form a dipole antenna 600 having suitable signal receptive properties over the frequency ranges in question without requiring significant addition circuitry or signal processing to mobile telephone 10 and without occupying any physical space within mobile telephone 10. As shown schematically in FIG. 1, dipole antenna 600 may be configured to within headset 500 and connected to mobile telephone 10 via electric plug 570 or any suitable mechanism.

Relating specifically to dipole antenna 600, a feed point 605 may be provided in an essentially symmetric relationship between cable section 510B and 510C, thereby enabling use of a balun and/or a matching network for providing a balanced feed of dipole 600. Such an arrangement has been schematically illustrated in FIG. 4 as connections between receiver RX 515 comprising a balun and/or a matching network and having two terminals 610 and 615 connected to second cable section 510B and third cable section 510C, respectively. Terminals 610 and 615 have been provided with opposite signs (+/−) to indicate that the dipole 600 is preferably fed with two currents having a substantially equal magnitude and being out of phase by 180°. That is, dipole antenna 600 may be operating in a balanced or differential mode.

As illustrated in FIG. 4, receiver RX 515 may be implemented in the cable, e.g. near the gap between the cable sections 510B and 510C. However, in additional implementations, receiver RX 515 may be integrated within or in connection with television unit 38 as shown in FIG. 3. For example, receiver 515 may include a television tuner operatively arranged within television unit 38. In this implementation, feed lines and conductor 509 may be provided along headset 500 to mobile telephone 10 via plug 570.

In the implementations described above, it should be noted that dipole 600 may be configured independently of a ground plane, which may be required for previous antenna solutions in connection with mobile telephone 10. Because cable sections 510B and 501C include shield 503, which is typically connected to a ground in mobile telephone 10, grounding is removed as an issue.

As shown in FIG. 4, dipole antenna 600 may be formed by shield 503 of cable 502 for headset 500. However, for embodiments in which shielding 503 is not provided in cable 502, dipole antenna 600 may be formed using conductors 505-508 within cable 502, in the manner described above.

In some embodiments of the present invention cable 502 of headset 500 may include two or more dipole antennas 600, thereby facilitating reception of multiple broadcast wavelengths. In this embodiment, the dipoles-halves may be arranged one after the other along the cable separated by high frequency blocking devices 520, 530 as described above. In an alternative arrangement, shield 503 may form a first dipole antenna, 600 while a second dipole antenna may be formed using conductors 505-508 within cable 502.

Consistent with aspects described herein, a plurality of dipole antennas for different frequencies may also be provided by using shared dipole-halves. Shared dipole-halves may be configured by providing a first set of two dipole-halves isolated and separated by means of high frequency traps, e.g., as illustrated for the dipole halves 510B, 510C in FIG. 4 being isolated by the high frequency traps 520, 540 and separated by the high frequency trap 530. A second set of shorter dipole-halves may then be configured for receiving a broadcast signal having a higher frequency by providing each of the longer dipole-halves (e.g., sections 510B and 510C) in the first set of dipole-halves with a further frequency trap (not shown). The further frequency trap may be arranged to disrupt the higher frequency that is to be received by the second set of dipole-halves and to permit the pass through of a lower frequency to be received by the longer first dipole-halves. In this arrangement, the first frequency trap (i.e., formed by gap 518 and high frequency blocking devices 530) is configured to disrupt both the higher and the lower frequencies being received.

Although dipole antenna 600 has been described above with respect to headset cable 502 connected to mobile telephone 10, it should be understood that dipole antenna 600 as described above may be implemented in any suitable cable configured to connect an auxiliary device to the portable electronics device. Headset 500 is merely an example of such a suitable auxiliary device.

CONCLUSION

An antenna for a portable electronic device has been described herein. An auxiliary device connected to the portable electronic device may be configured to include a dipole antenna configured to enable reception of signals having at least two distinct frequency ranges. Sections in the auxiliary device may be separated by gaps having frequency blocking elements therein.

The foregoing description of exemplary embodiments of the invention provides illustration and description, but is not intended to be exhaustive or to limit the invention to the precise form disclosed. Modifications and variations are possible in light of the above teachings or may be acquired from practice of the invention. For example, while the antenna described herein was described primarily in relation to a headset for use with a mobile telephone, it should be understood that additional electronic devices or auxiliary devices may be used, such as a portable media player and headphones connected thereto.

It will also be apparent to one of ordinary skill in the art that aspects of the invention, as described above, may be implemented in many different forms of software, firmware, and hardware in the implementations illustrated in the figures. The actual software code or specialized control hardware used to implement aspects described here is not limiting of the invention. Thus, the operation and behavior of the aspects described herein were described without reference to the specific software code or instructions—it being understood that one of ordinary skill in the art would be able to design software and control hardware to implement the aspects based on the description herein.

Further, certain portions of the invention may be implemented as "logic" or a "component" that performs one or more functions. This logic may include hardware, such as an application specific integrated circuit or a field programmable gate array, software, or a combination of hardware and software.

No element, act, or instruction used in the description of the invention should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. An antenna unit for a portable electronic device, comprising:

a single cable, having a shield extending alone an outer length of the single cable, to connect to the portable electronic device; and at least one pair of antenna elements, formed by the shield, and linearly arranged along the length of the single cable to form a dipole antenna to receive television signals.

2. The antenna unit of claim 1, where a feed point of the dipole antenna is positioned in an essentially symmetric manner with respect to the at least one pair of antenna elements.

3. The antenna unit of claim 2, where the dipole antenna is arranged to be operatively fed in a substantially balanced manner.

4. The antenna unit of claim 2, where the dipole antenna is arranged to be operatively fed in a balanced manner by one of:

a balun or a matching network.

5. The antenna unit of claim 1, where at least one additional antenna element is arranged on the outside of the at least one pair of antenna elements formed by the shield.

6. The antenna unit of claim 1, where the antenna elements of the at least one pair of antenna elements are separated by a gap.

7. The antenna unit of claim 6, where a high frequency trap is provided in the gap to disrupt high frequency signals while passing low frequency signals.

8. The antenna unit of claim 6, where a high frequency blocking device is provided in the gap between the antenna elements in the at least one pair of antenna elements.

9. The antenna unit of claim 1, where the antenna elements of the at least one pair of antenna elements have lengths proportionate to a wavelength of a signal to be received.

10. The antenna unit of claim 9, where the antenna elements of the at least one pair of antenna elements have lengths represented as:

$$\text{length}=N\cdot\lambda/4,$$

where N is an integer.

11. The antenna unit of claim 9, where each antenna element has a different length.

12. The antenna unit of claim 1, where a plurality of antennas is formed by pairs of antenna elements arranged substantially one after the other along the cable.

13. The antenna unit of claim 1, where a plurality of antennas is formed by antenna elements using shared dipole-halves.

14. The antenna unit of claim 1, where the portable electronic device comprises a mobile telephone.

15. The antenna unit of claim 1, where the cable connected to the portable electronic device comprises a headset.

16. A portable communication device comprising:

a detachable auxiliary device, including:

a single cable, having a plurality of conductors along a length of the single cable, to connect to the portable communication device; and an antenna unit having at least two antenna elements, formed by a single conductor of the plurality of conductors, linearly arranged along the length of the single cable to form a dipole antenna to receive television signals.

17. The portable communication device of claim 16, where the plurality of conductors comprise:

a plurality of inner conductors.

18. The portable communication device of claim 16, where a plurality of dipole antennas is formed by a plurality of antenna elements arranged one after the other along the cable.

19. The portable communication device of claim 16, where a plurality of antennas is formed by a plurality of antenna elements using shared dipole-halves.

20. The portable communication device of claim 16, where the at least two antenna elements are separated from each other and from the rest of the cable by high frequency traps.

21. The portable communication device of claim 16, where the portable communication device is a digital media player.

22. The portable device of claim 16, where the auxiliary device is a headset.

23. An external antenna for a portable electronic device, comprising:

a single cable connected to the portable electronic device;

a pair of antenna elements linearly arranged along the length of single cable to form a dipole antenna to receive television signals, the pair of antenna elements separated by a high frequency blocking device, where the pair of antenna elements is formed by one of:

a single conductor of a plurality of conductors arranged along a length of the single cable; or a shield extending along an outer length of the single cable;

where a length of the antenna elements in the pair of antenna elements is related to a wavelength of the received television signals; and a feed point operatively connected to the antenna elements substantially between the pair of antenna elements, where the feed point is operatively connected to a receiver that receives the television signals.

* * * * *